United States Patent [19]

Acquaviva et al.

[11] Patent Number: 4,745,438

[45] Date of Patent: May 17, 1988

[54] AUTOMATIC COPIER SHOW-AROUND ERASE SYSTEM

[75] Inventors: Thomas Acquaviva, Penfield; Donald W. Schaeffer, Webster, both of N.Y.

[73] Assignee: Xerox Corporation, Stamford, Conn.

[21] Appl. No.: 908,052

[22] Filed: Sep. 16, 1986

[51] Int. Cl.[4] ..... G03G 21/00

[52] U.S. Cl. ..... 355/14 SH; 355/14 E; 355/55

[58] Field of Search ..... 355/3 R, 3 SH, 14 SH, 355/14 E, 55

[56] References Cited

U.S. PATENT DOCUMENTS

| | | | |
|---|---|---|---|
| 3,556,655 | 1/1971 | Lux et al. | 355/55 |
| 3,685,894 | 8/1972 | Lux et al. | 355/3 |
| 3,689,143 | 9/1972 | Case et al. | 355/3 |
| 3,751,155 | 8/1973 | Liechty | 355/3 |
| 3,792,913 | 2/1974 | Simmons | 355/7 |
| 3,809,472 | 5/1974 | Liechty | 355/3 R |
| 3,827,803 | 8/1974 | Shelffo et al. | 355/3 R |
| 3,860,338 | 1/1975 | Reehil | 355/14 |
| 3,967,893 | 9/1976 | Majewicz | 355/4 |
| 4,023,896 | 5/1977 | Koch | 355/3 R |
| 4,080,071 | 3/1978 | Kobayashi | 355/75 |
| 4,236,811 | 12/1980 | Hirose et al. | 355/14 R |
| 4,277,163 | 7/1981 | Ikesue et al. | 355/14 R |
| 4,351,606 | 9/1982 | Franko | 355/14 R |
| 4,384,785 | 5/1983 | Katoh et al. | 355/14 E X |
| 4,406,537 | 9/1983 | Mori | 355/14 SH |
| 4,440,487 | 4/1984 | Miura | 355/14 R |
| 4,505,575 | 3/1985 | Palumbo | 355/14 E |
| 4,552,447 | 11/1985 | Sagara et al. | 355/55 X |
| 4,575,227 | 3/1986 | Ito et al. | 355/56 |
| 4,579,444 | 4/1986 | Pinckney et al. | 355/14 SH |
| 4,579,445 | 4/1986 | Hasegawa | 355/3 R X |
| 4,615,611 | 10/1986 | Yoshiura | 355/55 X |

*Primary Examiner*—Fred L. Braun

[57] ABSTRACT

A fade-out system for a copier with a document feeder, for preventing the undesired development of areas of the photosensitive imaging surface relative to the desired latent images of the document with a variable magnification optical imaging system, preventing "show around" copy defects from the document feeder, where the document feeder transports the document sheets in a document path onto and over the copying platen of the copier. An array of plural document sensors is positioned in the document feeder for measuring both the length and width of the document sheets being transported onto the copying platen, and the fade-out system connects with and is controlled by both the array of plural document sensors and the magnification setting of the optical imaging system for preventing development of any areas of the photosensitive imaging surface outside of the latent images of the documents irrespective of the size of the document sheets or the magnification setting. The array of sensors is adjacent the platen and in the document path from both of the document sheet inputs to the platen. The fade-out system is further responsive to the actual size of the copy sheets on which copies are being made, for automatic flood illumination of areas of the photosensitive imaging surface outside of the smaller of the two of the document latent image area or the actual copy sheet size, by fading out any portions of the document latent image area which will not be engaged for image transfer by the copy sheet, and fading out otherwise developable nondocument latent image areas of the photosensitive imaging surface even if they are within areas of the photosensitive imaging surface which will be engaged by the copy sheets, so as to provide complete fade-out for any selected magnification or document size or copy size.

5 Claims, 2 Drawing Sheets

AUTOMATIC COPIER SHOW-AROUND ERASE SYSTEM

Figure 1:
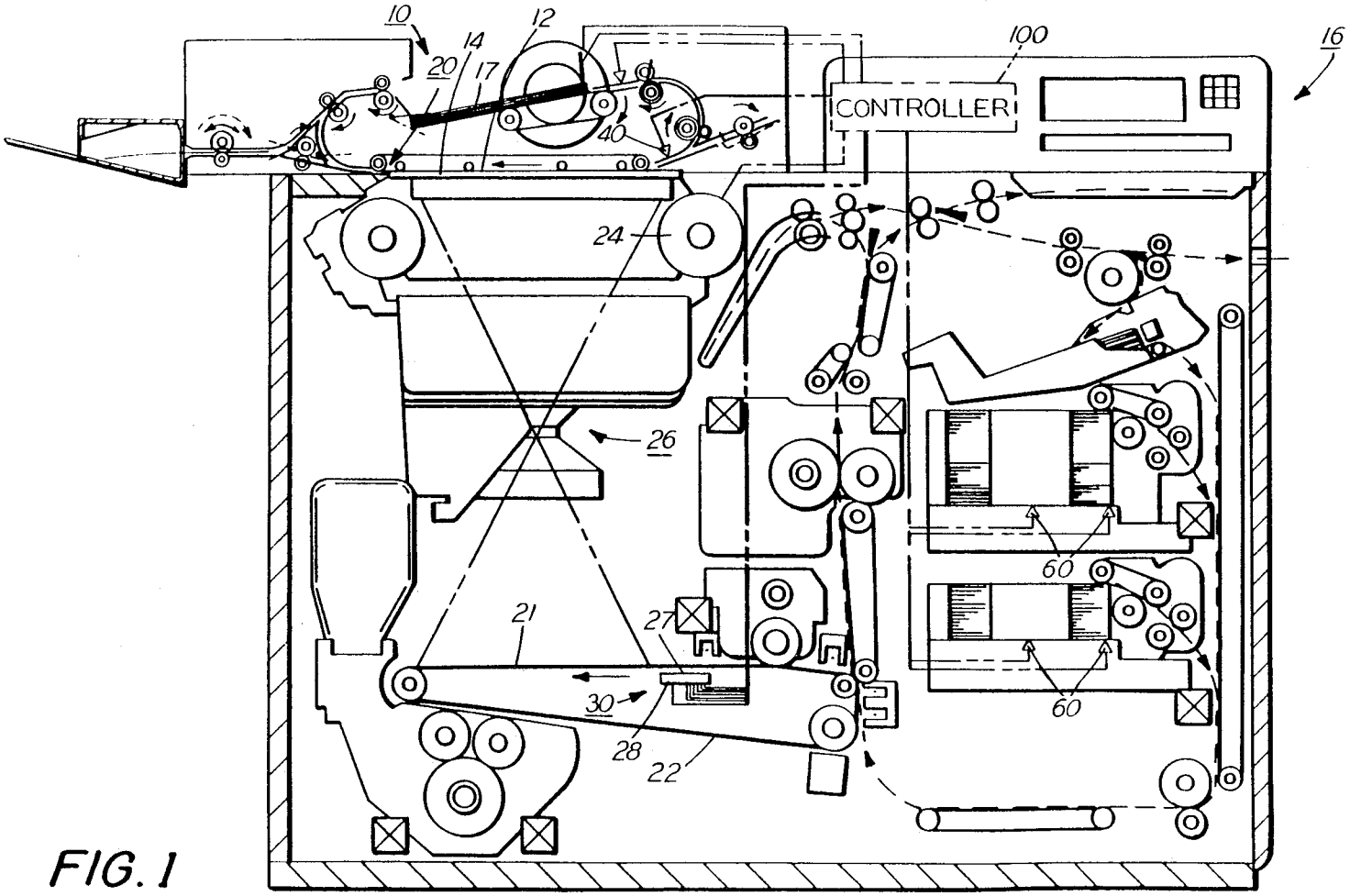

The invention relates to a system for the automatic elimination of undesirable images of anything other than the image of the original document on the copies therefrom in a copier with a document feeder, and more particularly to a system for automatic and more complete show-around erasure in response to the size of the document sheet being fed by the document feeder and the optical reduction or magnification ratio thereof to eliminate printout on the copy sheets of any part of the document feeder.

The art of original document sheet handling for copiers has been intensively pursued in recent years. Various systems have been provided for automatic or semiautomatic feeding of document sheets to be copied to and over the imaging station of the copier. The documents are normally fed over the surface of a transparent platen into a registered copying position on the platen, and then off the platen. Such automatic or semiautomatic document handlers eliminate the need for the operator to place and align each document on the platen by hand. This is a highly desirable feature for copiers. Document handlers can automatically feed documents as fast as they can be copied, which cannot be done manually with higher speed copiers, thus enabling the full utilization or productivity of higher speed copiers. Lower cost, more compact, and lighter weight document handlers are particularly desired. This is particularly true in the normal arrangement in which the document feeder is a part of and/or provides a repositionable (liftable) platen cover overlying the copier platen.

A document handling system preferably utilizes the existing or generally conventional copier optical imaging system of the copier on which it is mounted, including the external transparent copying window (known as the platen) of the copier.

However, a document handling system should also desirably provide a suitable white imaging background surface platen cover member overlying the platen against which documents can be copied without serious "show-through" or "show-around" copy defects (undesirable images from the document handler appearing on the copy sheets). That is difficult to accomplish.

The appropriate type of document transport and registration system is affected by the type of copier optics, i.e., the copying system. In either a scanning (moving) optics system, or a full frame or flash imaging system, the platen is stationary and the entire document image area to be copied must be overlying the platen in the desired imaging area of the copier optics system during copying, and normally and desirably the document is held stationary against the platen during copying.

The present invention is not limited to a particular or specific type of document illumination or optics system. It is particularly suitable for allowing a less critical and wider variety of document handlers by reducing "show-around" criticality.

A long recognized problem in copiers with automatic or semiautomatic original document feeders is a copy defect problem caused by imaging of portions of the document feeder overlying the platen. This is a particular problem with vacuum document transports and with reduction (reduced magnification) copying, wherein areas of the document transport outside of the area thereof covered by the document sheet are imaged onto the copy sheet. The vacuum apertures in the document vacuum transport areas so imaged can produce shadows or other reduced illumination area images which can print out as black marks on the copy sheet, especially if the aperture edges become darkened by contamination. This is known as the "show-around" problem. It is discussed, for example, in U.S. Pat. Nos. 4,047,812, 4,298,277 and 4,412,738. As noted in these and other references cited therein, various attempts have been made to overcome this problem. This same problem can occur with frictional nonvacuum document feeders as well. Even single wide unapertured document platen transport belts can easily become contaminated with use, and develop dark lines or spots which can print out. Likewise document platen transport systems using rollers.

This same problem can occur even at normal magnification when copies are being made of documents which are smaller than normal size documents, or where a document of one size is being copied onto a copy sheet of a larger size without sufficient magnification to "fill" the entire area of the larger document, or wherein the ratio of dimensions of the document (length vs. width) does not match the ratio of dimensions of the copy sheet. As shown by the references, one of the attempted solutions has been to attempt to eliminate as much as possible the generation of shadows or other image areas in the vacuum transport. However, this is difficult to fully accomplish, because a vacuum transport system inherently requires either vacuum apertures in the belt or plural belts with vacuum apertures defined by the spaces therebetween.

A different, but related, problem in xerographic copying has been the elimination of development (toner pickup) in areas of the photoreceptor outside of the desired copy image area on the photoreceptor. This has been accomplished by removing the toner-acquiring electrostatic charge in most of those nonimage areas, normally by "flood illumination" of the photoreceptor in nonimage areas, to the extent these areas can be determined and to the extent this can be done without accidentally erasing the desired latent image areas. This reduces both toner consumption and toner contamination in the copier.

In a copier with a uniformly light reflective platen cover overlying the platen, this reflective (usually white) document imaging background surface inherently and automatically provides this desired discharge of nonimage areas around the document image area, by reflecting light onto the photoreceptor from the same illumination system which is illuminating the document during its exposure. However, if any portion of the platen cover is not fully reflective (and that includes the above-noted problems when this platen cover is defined by a vacuum document transport) then this platen cover system of nonimage area "fade-out", as it is called, is not fully effective. One example of such a reflective imaging background surface for discharging the photoreceptor is disclosed in U.S. Pat. No. 4,120,579 issued Oct. 17, 1978 to D. J. Maiorano. In this patent the reflector is behind a transparent document transporting belt and is intended to fade out the apertures therein. Some other examples of efforts to make a document vacuum belt invisible to the copier optics are disclosed in U.S. Pat. Nos. 4,047,812 issued Sept. 13, 1977 to J. W. Hogan; 4,286,870 issued Sept. 1, 1981 to Morton Silverberg; 4,298,277 issued Nov. 3, 1981 to Morton Silverberg; and 4,412,738 issued Nov. 1, 1983 to D. K. Ahern et al. However, it will be appreciated that this will not work if either the belt or the reflective surface becomes contaminated or worn, as often happens in actual use.

Thus, for example, as early as the prior art "Xerox" "7000" copier/duplicator, separate photoreceptor discharge or erase lamps have been additionally provided. In that copier an elongate electroluminescent (phosphor glow) strip lamp with selectably illuminatable segments was utilized to discharge a selected portion of one edge area of the photoreceptor in response to the operator selection of letter or legal size copy paper. That is, when letter paper was selected, a correspondingly larger area of the photoreceptor was so illuminated and therefore discharged to prevent toner development in that area.

A more recent example of an appropriate erase or fade-out illumination system (using plural neon lamps) for a copier is disclosed in U.S. Ser. No. 798,370 filed Nov. 18, 1985, now U.S. Pat. No. 4,695,152, as a continuation of Ser. No. 676,030 filed Nov. 28, 1984, now abandoned, by Charles J. Urso, commonly assigned, and entitled "Charge Erase Device For An Electrophotographic Printing Machine". Strips or arrays of multiple LED's are also known for photoreceptor flood erase lamps.

Various other examples of erasing systems for nonimage areas, or "fade-out" systems as they are often called, include U.S. Pat. Nos. 4,505,575 issued Mar. 19, 1985 to S. A. J. Palumbo; 3,792,913 issued Feb. 19, 1974 to L. A. Simmons; 3,860,338 issued Jan. 14, 1975 to E.G. Reehil, and others noted herein. Other fade-out system patents include Xerox Corporation U.S. 3,809,472 and 3,751,155; and U.S. Pat. No. 4,080,071 issued Mar. 21, 1978 to T. Kobayashi.

The following patents variously relate to providing edge fade-out with reduction copying, utilizing a mask or edge exposure lamps that are selected to variably cover or discharge the photoreceptor: U.S. Pat. Nos. 3,556,655 and 3,685,894 to G. K. Lux et al; 3,827,803 to L. E. Shelffo et al; and 4,023,896 to R. M. Koch.

It will be noted that there are actually two separate problems, and types, of such erase or fade-out. There is "edge-erase" or "edge fade-out" of one or both sides of the photoreceptor, transverse its direction of motion. If the copier is of the "edge-registered" rather than "center-registered" type, then one edge of the document image will always be aligned with one edge of the photoreceptor, and thus only one (the other) side needs to be variably erased. Then there is "pitch erase" or "pitch fade-out", which is the erasure of charge in the interimage areas in the direction of movement of photoreceptor, i.e. the "pitch space" in between copy images. This is conventionally accomplished by flood illumination of the entire transverse dimension of the photoreceptor surface for a present time period corresponding to the corresponding movement of the photoreceptor past said flood illuminator for the pitch distance between the image areas.

If it is desired to precisely flood this entire pitch area, yet not accidentally erase any of the desired images, then the actual size of the document image to be transferred to the copy sheet must be known and coordinated with the flood illumination. Only knowing the size of the copy sheet and controlling the extent of erasing flood illumination just from the copy sheet dimensions is common, but is not fully sufficient. The same is true for providing complete edge fade-out.

This is further complicated if the document is registered at a variable registration position on the copying platen, as with variations in its dimension or magnification, as in the document registration system of U.S. Pat. No. 4,579,444 issued Apr. 1, 1986 to T. S. Pinckney and H. J. Sanchez.

Another potentially interrelated additional feature which may be provided with a copier is sometimes referred to as "auto-fit". This is a copying system in which, for example, sensors indicating the size of the original document sheets being copied are compared with similar signals from sensors indicating the size of the copy sheets selected, and this electrical information is compared to automatically adjust the copying magnification or reduction so that the image of the document is fully "fitted" within the copy sheet, to the extent allowed by the magnification system and by the ratios of dimensions of the document and copy sheets. Alternatively, or additionally, a different size of copy sheet may be automatically selected in response to a preselected copying reduction or magnification. In regard to the former, particularly noted are U.S. Pat. Nos. 4,351,606 issued Sept. 28, 1982 to E.B. Franko and 3,689,143 issued Sept. 5, 1972 to R.D. Case et al. Also noted are U.S. Pat. Nos. 4,277,163 issued July 7, 1981 to M. Ikesue et al (Ricoh) and 4,406,537 issued Sept. 27, 1983 to G. Mori (Ricoh). An appropriate fade-out system should be compatible with an "auto-fit" system.

Merely by way of alternative systems, U.S. Pat. No. 3,944.356 issued Mar. 16, 1976 to T. F. Hayne is noted in regard to its system for controlling the area of the imaging surface which is charged to correspond substantially in size to the copy sheet, by sensing the size of the copy sheet. U.S. Pat. No. 3,503,677 issued Mar. 31, 1970 to T. Uchiyama discloses a masking device for masking part of the exposure area not occupied by the photosensitive paper.

Various other individual features of document dimension and/or copy dimension measurements and edge-erase systems can be found in various commercial copier products. For example, some copiers roughly measure at least one dimension of the document size on the platen glass, and use that information to select a copy sheet size from those available. The Minolta "EP 650Z" TM measures some dimensions of the document size in a SADH document handler input and for certain standard document sizes provides an operator selection of an automatic magnification change or an automatic copy sheet tray feed (copy size) selection, ("auto-fit") within limits. However, the inventors as of the date of this application are not aware of any copier in which the document size is measured in the document feeder to automatically control edge-erase and preclude show-around, much less one providing the additional features claimed herein.

It is important to distinguish electronic copying systems which read and store images of documents electronically and create copies by writing on a photreceptor with a laser beam, or the like, since they do not have the problems or erase systems dealt with here.

The present invention overcomes various of the above-discussed problems and provides various of the above other features and advantages.

It is a general feature of the system disclosed herein to provide a more complete and accurate elimination of "show-around" problems with a more complete and accurate fade out of the nonimaging areas by automatically variably controlling the fade-out system in response to the selection of the actual size of the original document sheet in both dimensions combined with the selected reduction or magnification ratio, and also with the size of the copy sheet, to insure that all potentially developable areas of the photoreceptor outside of the actual transferable image area from the document are fully faded out (erased so as not to be developable).

With this system a larger than normal area of the photoreceptor is automatically faded out during copying of smaller documents and with reduction copying. Also, because this system can automatically fade out even parts of the area of the photoreceptor engaged by the copy sheet, regardless of the size of the copy sheet (not just the areas of the photoreceptor outside of the copy sheet engagement area), undesirable background imaging from "show-around" or any other source can be eliminated outside of the actual document image area on the copy sheet, even if that document sheet image area is much smaller than the copy sheet area. Improved interdocument or pitch fade-out is provided with the same system in this same manner. This disclosed system is applicable to all types of document handlers or feeders, but is particularly valuable for vacuum document transports and/or other document feeders having particular problems with "show-around" copy defects.

This system may be utilized with and accommodate any size of copy paper. There is provided effective fade-out to the actual image area independently of the size of the copy paper selected or utilized when the document image area is smaller than the copy sheet, and effective fade out to the actual size of the copy paper selected or utilized independently of the size of the document image area when the image area is larger than the copy sheet.

An additional feature of the automatic fade-out system disclosed herein is that this system can insure clean borders or edge areas on the copy sheet even where the reduction of the document image by "auto-fit" or selected reduction leaves border areas on the copy which are outside of the the document sheet image area.

A feature of the automatic fade-out system disclosed herein is that it can fade out the photoreceptor area to the smaller of the two of the image on the photoreceptor or the copy sheet dimensions, i.e., fade out all but whichever is smaller. That is, it will provide complete fade-out even if the image area of the photoconductor is smaller than the copy sheet, or the copy sheet is smaller than the image area. In the latter case, this precludes undesirable toner imaging of those portions of the actual latent image area on the photoreceptor which cannot be transferred to the copy sheet, thereby reducing toner consumption and toner contamination within the copier, and reducing the cleaning load on the copier cleaning system.

The exemplary system disclosed in the embodiment herein does not require over-platen document size sensors. The document sensing is preferably accomplished by plural sensors measuring both the width and length dimensions of the copy sheet i.e. the dimensions of the copy sheet transverse the direction of movement onto the platen and in the direction of movement toward the platen, as the document sheet is being fed by the regular feeding system of the document feeder onto the platen. Thus the document dimension sensors do not contribute to or cause any "show-around" or "show-through" problems themselves since they are not ever in the imaging area of the platen. Also, with this position, the sensors are operative for all modes of document feeding. In this regard, the previously cited U.S. Pat. No. 4,579,444 issued Apr. 1, 1986 and filed Dec. 6, 1984 by T. S. Pinckney et al is particularly of interest and is incorporated for its disclosure of plural sensors 31 upstream of the platen for measuring the transverse length of the document and the related system for measuring the width of the document in its movement direction.

A feature of the specific embodiment disclosed herein is to provide a copier or copier/printer with a photosensitive imaging surface and a variable magnification optical imaging system with magnification setting means and a copying platen on which various sizes of document sheets may by variably sequentially imaged by the magnification setting of said optical imaging system onto the photosensitive imaging surface as latent images to be developed and transferred to copy sheets, wherein the copier has a fade-out system for at least partially preventing the development of some areas of the photosensitive imaging surface adjacent the latent images thereon of the document sheets, the improvement comprising a document sheet transport for transporting the document sheets in a document path onto and over the copying platen of the copier, an array of plural document sensing means integral said document sheet transport and positioned in the document path of said document sheet transport for measuring both the length and width of the document sheets being transported onto the copying platen of the copier, variable area fade-out means connecting with and controlled by both said array of plural document sensing means and the magnification setting means of said variable magnification optical imaging system for preventing development of variable areas of said photosensitive imaging surface outside of said latent images of the documents irrespective of the size of the document sheets or said magnification setting, so as to prevent "show-around" imaging of said document sheet transport on said copy sheets.

Further features provided by the system disclosed herein, individually or in combination, include those wherein said document sheet transport is a part of a document handler with two separate document sheet inputs for either recirculating a stack of document sheets or semiautomatically feeding larger document sheets, and said array of plural document sensing means is positioned adjacent said platen and in the document path from both of said document sheet inputs to said platen, wherein said fade-out means includes automatically variable area flood illumination exposure means for flood illuminating fade-out of variable areas of said photosensitive imaging surface to prevent their development, wherein said fade-out system means further includes and is responsive to means for indicating the size of the copy sheets on which copies are being made, for automatically preventing development of areas of said photosensitive imaging surface outside of the smaller of the two of the document latent image areas on the photosensitive imaging surface or said actual copy sheet size indication, by fading out any portions of the document latent image area which will not be engaged for image transfer by the copy sheet, and fading out otherwise developable nondocument latent image areas of the photosensitive imaging surface even if they are within areas of the photosensitive imaging surface which will be engaged by the copy sheets, so as to provide complete fade-out for any selected magnification or document size or copy size even if the document latent image area is smaller than the copy sheet or the copy sheet is smaller than the document latent image area, to prevent either "show-around" copy defects or undesirable development of portions of the document latent image area which cannot be transferred to the copy sheet, wherein said fade-out means further includes means for automatically providing an additional preset illumination fade-out of approximately 2 mm of at least one outer edge of the document latent image area on the photosensitive imaging surface to eliminate any latent images of any shadows of the document sheet edge, wherein said document sheet transport is a part of a apertured belt type document handler with two separate document sheet inputs for either recirculating a stack of document sheets or semiautomatically feeding larger document sheets, and said array of plural document sensing means is positioned adjacent said platen and in the document path from both of said document sheet inputs to said platen, wherein said fade-out means includes automatically variable area flood illumination exposure means for flood illuminating fade out of variable areas of said photosensitive imaging surface to prevent their development, wherein said fade-out means is operated and controlled in accordance with all of the following parameters:

1. If document width X magnification < copy width, then fade out to the former;

2. If document width X magnification > copy width, then fade out to the latter;

3. If document length X magnification < copy length, then fade out to the former;

4. If document length X magnification > copy length, then fade out of the latter.

Some examples of various other prior art copiers with document handlers, and especially with control systems therefor, including document sheet detecting switches, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in this art, and in general, how to program and execute document handler and copier control functions and logic with conventional or simple software instructions for conventional microprocessors. This is taught by the above and other patents and various commercial copiers. Such software may vary depending on the particular function and particular microprocessor or microcomputer system utilized, of course, but will be available to or readily programmable by those skilled in the applicable arts without experimentation from either descriptions or prior knowledge of the desired functions together with general knowledge in the general software and computer arts. It is also known that conventional or specified document handling functions and controls may be alternatively conventionally provided utilizing various other known or suitable logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures (approximately to scale), wherein:

FIG. 1 is a front view of one example of the present invention incorporated into an exemplary commercial xerographic copier and its associated exemplary document handler, providing the automatic fade-out features described above; and FIG. 2 is a simplified end view thereof.

Describing now in further detail the specific example illustrated in the Figures, there is shown a document handling system 10, including a multibelt document vacuum platen transport system 12 thereof as disclosed in U. S. Pat. No. 4,589,651 or 652 or the like, for sequentially transporting document sheets onto and over the conventional platen 14 of a copier 16. This platen transport system 12 is also adapted to automatically register each document sheet 17 at an appropriate registration position on the platen 14, here at a corner or left and rear edge position. Registration is provided by an integral registration system 20 for engaging, stopping and deskewing, without damage, the lead edge of each document sheet 17 at the appropriate registration position on the platen 14.

The document 17 is then conventionally illuminated and copied by being imaged onto an image area 21 of the photoreceptor 22 of the copier 10. Sequential exposures of documents 17 are conventionally made onto sequentially spaced areas 21 of the photoreceptor 22. The image areas 21 are determined by the size of the document 17 and by the imaging magnification (normally a reduction), which is determined by the selected setting of the magnification control system 24 of the copier optical imaging system 26, as taught for example in U. S. Pat. No. 4,505,581 issued Mar. 19, 1985 to F. A. Seedhouse et al. The generic term variable "magnification" optical imaging system will be used herein to refer to either or both variable optical reduction or magnification of the document image. As noted, the former is more common, i.e., optically reducing or shrinking the original document image onto a smaller copy sheet and/or a part of a copy sheet. However, the latter is also provided in some copiers, especially to "overfill" or edge bleed the image. Although a full-frame optical system with one fixed position edge is shown in the FIG. 2 embodiment, it will be appreciated that the disclosed system may also be used with a center-registered optics system in which both edges are variably faded out. It may also be used with scanning optics systems with variable magnifications. Examples include U.S. Pat. Nos. 4,095,880,4,093,374 and 4,032,231 and their cited references.

Figure 2:
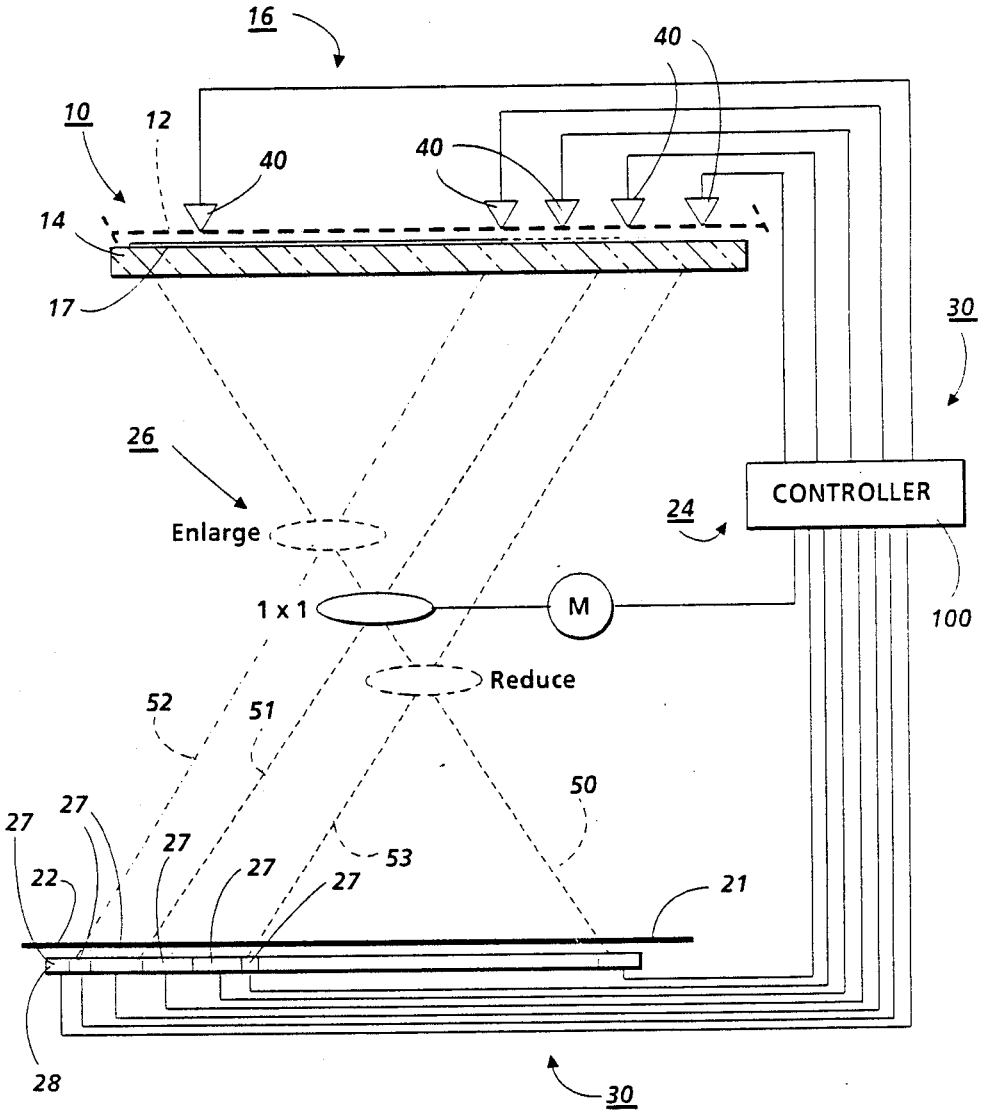

Here, the areas of the photoreceptor 22 around and between the the image areas 21 (and even within these areas 21 in some cases) are exposed with charge dissipating flood illumination by selected elements 27 of a multielement flood or fade-out lamp system 28 at selected times controlled by the copier controller 100 as described herein to form an automatic fade-out system 30. The fade-out lamp system 28 may be upstream (as shown) or downstream of the area of the photoreceptor 22 which is image exposed by the image of the document to form a latent and toner-developable image of the document. FIG. 2 illustrates examples of exemplary image rays and therefore image edge positions for, respectively, the common front edge ray 50, a normal (1X) rear edge ray position 51, an exemplary magnification position 52 and an exemplary reduction position 53, for which appropriate fade-out lamp 28 elements 27 are provided and activated. The number of elements 27 may be much greater than the number illustrated here.

The document handling system 10 and its platen transport system 12 illustrated here are exemplary, and may be readily modified for different copiers. It has two separate document inputs, a recirculating or RDH input stacking tray on top, and an SADH side entrance for semiautomatic document handling, especially for larger documents, which may be optionally inserted short edge first there. The term "apertures" in a "apertured belt" type document sheet transport here is generically used to encompass not only the spaces between the illustrated plural belt document transport, but also single belt vacuum document transports with vacuum apertures, since they also have the "show around" copy defect problem addressed here. Examples have been incorporated in above-cited references.

The exemplary copier 16 shown here is a modified version of the well known "Xerox" "1075" or "1090" xerographic copiers, illustrated and described in various patents. Since the fade-out system 30 described herein may be readily utilized with various other conventional or appropriate copiers, the nonrelevant details of the copier need not be described herein. Sensors 60 or other known means are provided to measure the length and width of copy sheets being fed for copying.

It will also be appreciated that although the document handling system disclosed herein is a dual mode recirculating or SADH document handler, that the disclosed fade-out system may be variously utilized as or incorporated into a semiautomatic, fully automatic (stack fed), and/or other document feeder, of which various examples have been provided in the references cited above, and their references.

Although one dual-function lamp array 28 is illustrated, two separate erase lamp systems may be used, i.e., a separate interdocument or pitch fade-out lamp and a separate edge-erase lamp. Furthermore, the edge-erase lamp may use a single lamp with automatically repositionable sliding or pivotable shutters, as variously shown in the prior art, rather than multiple lamps or plural lamp sectors 27. The operation of such lamps was discussed in the introduction above and is described in the art cited therein.

The elimination of "show-around" is accomplished in both the RDH and SADH modes in the same manner, by using both the interdocument lamp and the edge erase lamp functions to automatically fade out the photoreceptor to the smaller of the size of the actual image area on the photoreceptor or the size of the copy paper. The fade-out system 30 automatically variably controls the areas of fade-out in response to the actual size of the original document sheet in both dimensions combined with the selected reduction or magnification ratio, and also with the size of the copy sheet, to insure that all potentially developable areas of the photoreceptor outside of the actual transferable image area from the document are fully faded out so as not to attract toner.

With this system all of the nondocument image area of the photoreceptor is automatically faded out even during copying of smaller documents or with reduction copying. But this system can also automatically fade out even parts of the actual latent image area, particularly those parts which will not be engaged by the copy sheet. The system 30 is programmed to fade out the entire photoreceptor down to (except for) the smaller of the two of: (a) the actual document image on the photoreceptor, or (b) the actual copy sheet dimensions, whichever is smaller. That is, the system 30 will provide complete fade-out for any selected magnification or reduction or copy or document size, even if the image area is smaller than the copy sheet, or even if the copy sheet is smaller than the image area. In the former case, this precludes "show-around" copy defects. In the latter case, this precludes undesirable toner imaging of those portions of the actual image area on the photoreceptor which cannot be transferred to the copy sheet, thereby reducing toner consumption and toner contamination within the copier, and reducing the cleaning load on the copier cleaning system.

As noted, this complete fade-out is desirable for several reasons. It eliminates imaging of any platen transport feature such as dirty belts or vacuum plenum grooves. It avoids overloading the photoreceptor cleaning system with untransferred toner produced by such imaged features. Furthermore, even for the normal copy mode, (one-to-one ratio or zero magnification) it can automatically provide, as an additional feature, a preset erasure of approximately 2 mm into the photoreceptor image area to eliminate any images of shadows of the document sheet edge. This avoids having to resort to 1.02–1.05 magnification "over fill" for the normal copy mode, which is a common, but less desirable, way of overcoming this edge shadow problem (which is aggravated by any document sheet skew or edge curlup). Thus the image on the copies here may be the same size as on the original, rather than increasing in size with each generation of copies, yet not have undesirable black edges.

The disclosed erase system will erase the vacuum holes "show-around" of a wide belt vacuum platen transport with a hole pattern. The disclosed multibelt transport does not have such holes showing on the transport, but with extensive usage tends to print out dirty belts and grooves. The complete surround-erase provided here avoids printing out these features as well.

The document size sensor array 40 here is at the input to the platen, in an area which is common to both the RDH and SADH document paths, to sense the length of the input document from either. Note that in this example the documents are being fed long-edge-first in the RDH mode, so that the length of the document is transverse the direction of motion of the document, and document width is the dimension in the document feeding direction here, but this could be reversed. The preferred sensor locations are at 8, 28, 32, 34.5, and 40 centimeters (3.14", 11.4", 12.6", 13.6", and 15.75 inches) from the top (the rear of the platen) registration position. (An alternative is to provide a variable sensor or plural sensors sensing the repositioning of the RDH movable side guide, but that will not measure SADH input documents). As the input documents are fed past this sensor area, the first (rear-most) one, or more, of the sensors 40 (or another separate sensor) is interrogated by the controller 100 for its measured occlusion time to measure document width. At approximately the same time, measurements are made of the document length, as determined by which of the sensors 40 at said spaced locations are occluded. In conjunction with the reduction/enlargement ratio, an algorithm in the controller determines where to position the fade-out. The extent of fade-out may be determined by the number or area of lamps illuminated, as illustrated, or by the position of a fade-out lamp shutter. In a similar manner, there is a simple method programmed in the controller of taking the sensed input of copy length and width and determining the corresponding area on the photoreceptor which will be overlaid by that particular copy sheet, since this is a fixed relationship determined by the copier component dimensions and positions.

The document length software notes the first document sensor in the document size sensor array furthest from the rear (top) registration edge which is not covered by the incoming document, to indicate the rough document length measurement. After both the document length and width have been roughly measured as described, the system then preferably also determines, e.g., from a standard "look-up table", the probable standard size of the document which is being run, i.e., it assumes that what has been detected is one of several possible standard documents, with a standard length corresponding to that length sensor location or zone and the feeding time zone. It then multiplies this standardized and precise length and width by the reduction/magnification ratio to determine the latent image size on the photoreceptor. If either of these latent image dimensions is smaller than the corresponding copy paper dimension, the flood exposed (faded out) area is moved up to the edge of this latent image position. If the copy paper dimensions are smaller than the latent image dimensions, the fadeout lamp exposure area moves up to the edge of where the copy paper position will be on the photoreceptor.

In addition, the software similarly uses the document width information to cycle the interdocument erase lamp on and off at and for the appropriate time periods to erase the photoreceptor before and after the image. This width erase time is also altered by the magnification/reduction ratio.

Since both aspects of the fed-in document are being measured, i.e., both the length and width, the system can also accommodate and measure with the same sensors for appropriate erase a document sheet being fed in short-edge-first from the SADH input rather than long-edge-first. This allows oversize documents to be accommodated. The copier controller 100 also knows from other sensors at the SADH input and in the RDH tray which document input to the sensors 40 is being used. The controller 100 can normally assume that documents from the RDH tray input are being fed long edge first.

To express the edge fade-out control function or process described herein in the form of a set of process steps or algorithm, it may be expressed as follows (where magnification is expressed decimally, e.g. 0.85 for 85% image reduction):

1. If document width X magnification < copy width, then fade out to latent image width. (Note that document width X magnification = latent image width.)
2. If document width X magnification > copy width, then fade out to copy width.
3. If document length X magnification < copy length, then fade out to latent image length. (Note that document length X magnification = latent image length.)
4. If document length X magnification > copy length, then fade out to copy length.

Note that the magnification is a preset determinant here. It is either manually preselected by the operator, or preselected by the "autofit" system if one is available and operative (selected). Likewise for the size of the copy paper.

If it is desired to not have any image loss, then the copier or this system must be preset or preprogrammed for this option, so that all of the latent image can be transferred to a copy sheet for that size document and/or magnification. That is, so that the conditions of steps 2. or 4. above do not occur.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a copier or copier/printer with a photosensitive imaging surface and a variable magnification optical imaging system with magnification setting means and a copying platen on which various sizes of document sheets may be variably sequentially imaged by the magnification setting of said optical imaging system onto the photosensitive imaging surface as latent images to be developed and transferred to copy sheets, wherein the copier has a fade-out system for preventing the development of areas of the photosensitive imaging surface adjacent the latent images thereon of the document sheets, the improvement comprising:

a document sheet transport for transporting the document sheets in a document path onto and over the copying platen of the copier;

an array of plural document sensing means integral said document sheet transport and positioned in the document path of said document sheet transport for measuring both the length and width of the document sheets being transported onto the copying platen of the copier;

means for indicating the size of the copy sheets on which copies are being made;

and fade-out means connecting with and controlled by both said array of plural document sensing means and said magnification setting means of said variable magnification optical imaging system for preventing development of variable areas of said photosensitive imaging surface in response to said length and width measuring of the document sheet being copied and said magnification setting, and wherein said fade-out means is further responsive to said means for indicating the size of the copy sheets on which copies are being made, for automatically preventing development of all areas of said photosensitive imaging surface outside of the smaller of the two of the document latent image areas on the photosensitive imaging surface or said actual copy sheet size indication, by fading out any portions of the document latent image area which will not be engaged for image transfer by the copy sheet, and fading out otherwise developable but nondocument latent image areas of the photosensitive imaging surface even if they are within areas of the photosensitive imaging surface which will be engaged by the copy sheets, so as to provide complete fade-out for a wide range of magnifications, document sizes, and copy sizes, even if the document latent image area is smaller than the copy sheet or the copy sheet is smaller than the document latent image area, to prevent either "show-around" copy defects or undesirable development of portions of the document latent image area which cannot be transferred to the copy sheet, and wherein said fade-out means is operated and controlled in accordance with all of the following parameters:

1. If document width X magnification < copy width, then fade out to the former;
2. If document width X magnification > copy width, then fade out to the latter;
3. If document length X magnification < copy length, then fade out to the former;
4. If document length X magnification > copy length, then fade out to the latter.

2. The copier of claim 1 wherein said document sheet transport is a part of a document handler with two separate document sheet inputs for either recirculating a stack of document sheets or semiautomatically feeding larger document sheets, and said array of plural document sensing means is positioned adjacent said platen and in the document path from both of said document sheet inputs to said platen.

3. The copier of claim 1 wherein said fade-out means includes automatically variable area flood illumination exposure means for flood illuminating fade-out of variable areas of said photosensitive imaging surface to prevent their development.

4. The copier of claim 3 wherein said same flood illumination exposure means is intermittently variably operated to flood illuminate and fade out all of said imaging surface in between said latent images in the direction of movement of said imaging surface and then fade out part of said imaging surface adjacent at least one side of said latent images transversly of the direction of movement of said imaging surface.

5. The copier of claim 1 wherein said fade-out means further includes means for automatically providing an additional preset illumination fade-out of approximately 2 mm of at least one outer edge of the document latent image area on the photosensitive imaging surface to eliminate any latent images of any shadows of the document sheet edge.

* * * * *